US005462311A

United States Patent [19]

Cipolla

[11] Patent Number: 5,462,311

[45] Date of Patent: Oct. 31, 1995

[54] TELESCOPING WAND FOR VACUUM CLEANERS

[75] Inventor: Mark E. Cipolla, Chardon, Ohio

[73] Assignee: Royal Appliance Mfg. Co., Cleveland, Ohio

[21] Appl. No.: 976,439

[22] Filed: Nov. 13, 1992

[51] Int. Cl.[6] ..... A47L 9/24

[52] U.S. Cl. ..... 285/7; 285/302; 285/298; 285/24

[58] Field of Search ..... 285/7, 298, 302, 285/307, 319, 24, 27, 361, 396, 303

[56] References Cited

U.S. PATENT DOCUMENTS

| | | | |
|---|---|---|---|
| 1,229,079 | 6/1917 | Hill | 285/396 |
| 1,542,553 | 6/1925 | Hornbeck | 285/303 |
| 1,679,709 | 8/1928 | Cooper | 285/361 X |
| 1,911,659 | 5/1933 | Weaver | 285/361 X |
| 2,099,984 | 11/1937 | Lundquist | 285/307 X |
| 2,196,459 | 4/1940 | Forsberg . | |
| 2,885,223 | 5/1959 | Duff | 285/307 X |
| 2,941,822 | 6/1960 | Moecker . | |
| 3,083,041 | 3/1963 | Owenmark . | |
| 3,244,437 | 4/1966 | Belicka et al. . | |
| 3,351,359 | 11/1967 | Ferraris . | |
| 3,351,363 | 11/1967 | Downey et al. . | |
| 3,389,923 | 6/1968 | Love, Jr. et al. | 285/369 X |
| 3,451,483 | 6/1969 | Van Houtte et al. . | |
| 3,534,317 | 10/1970 | Descarries et al. . | |
| 4,211,438 | 7/1980 | Asberg | 285/7 |
| 4,494,270 | 1/1985 | Ritzau et al. . | |
| 4,696,497 | 9/1987 | Schwarzensteiner | 285/307 |
| 4,738,474 | 4/1988 | Jacob et al. . | |
| 4,758,023 | 7/1988 | Vermillion | 285/7 |
| 5,039,133 | 8/1991 | Albrecht | 285/7 |
| 5,042,844 | 8/1991 | Iida et al. | 285/7 |
| 5,112,086 | 5/1992 | Gruber et al. | 285/319 |
| 5,215,336 | 6/1993 | Worthing | 285/319 X |

FOREIGN PATENT DOCUMENTS

| | | | |
|---|---|---|---|
| WO89/09361 | 10/1989 | WIPO | 285/319 |

OTHER PUBLICATIONS

Copy of photograph of admitted prior art telescoping wand.

*Primary Examiner*—Randolph A. Reese
*Assistant Examiner*—Heather Shackelford
*Attorney, Agent, or Firm*—Fay, Sharpe, Beall, Fagan, Minnich & McKee

[57] ABSTRACT

A telescoping assembly especially suited for vacuum cleaner wands includes a first tube having an outer diameter and a second tube having an inner diameter which is larger than the outer diameter of the first tube. In this way, the first tube fits within the second tube in an axially sliding manner. A collet is positioned within the second tube and encircles the first tube. The collet includes a locking element for selectively securing the first tube in relation to the second tube, the locking element cooperating with a portion of the second tube upon a rotation of the collet to prevent a telescoping movement of the first tube in relation to the second tube.

21 Claims, 3 Drawing Sheets

TELESCOPING WAND FOR VACUUM CLEANERS

BACKGROUND OF THE INVENTION

This invention pertains in general to telescoping conduits. More particularly, the present invention deals with an adjustable length conduit for a home appliance.

The invention is especially suited for telescoping wands used for vacuum cleaners. It should, however, be appreciated by those of average skill in the art that the invention could also be used in various other environments where telescoping conduits are employed.

In canister-type vacuum cleaners, a rigid, hollow wand is utilized between a suction hose and a suction-cleaning tool. The wand serves the dual purpose of providing a handle for manipulating the tool and a conduit for conveying air and dust from the tool to the hose. The tool may be a floor nozzle or it may be an above-the-floor cleaning brush, crevice tool, or the like. It is advantageous to be able to adjust the length of a wand depending on the type of cleaning task involved. For example, when cleaning drapery materials it is advantageous to have a long wand so as to be able to reach the upper end of the drapery fabric. In other environments, such as vacuuming a couch, a short length of wand is all that is required. Such telescoping wands have also proven advantageous for upright vacuum cleaners when they are used to do above-the-floor cleaning and even for portable, hand-held vacuum cleaners under certain circumstances.

Various types of telescoping wand assemblies are known for vacuum cleaners. Several of these can be telescopically adjusted and latched at one of a number of preset positions. Such wands are disadvantageous from the standpoint that only a limited number of preset lengths of wand are available. Other known types of telescoping wand assemblies enable an infinite adjustment of the wand by providing a means for locking which enables two wand sections to be locked together at any point along their length. However, all of the known wand assemblies of this nature involve the use of several additional parts, making such wand assemblies disadvantageous from the standpoint of complexity and cost due to the extra parts required. Various types of telescoping tubular conduits are also known for the delivery of fluids in various fields such as, e.g. sprinkler systems. However, these conduits also involve the use of numerous additional parts and are therefore disadvantageous.

Accordingly, it has been considered desirable to develop a new and improved telescoping assembly which would overcome the foregoing difficulties and others, while providing better and more advantageous overall results.

BRIEF SUMMARY OF THE INVENTION

In accordance with the present invention, a telescoping assembly is provided.

More particularly, in accordance with this aspect of the invention, the assembly comprises a first tube having an outer diameter and a second tube having an inner diameter which is larger than the outer diameter of the first tube wherein the first tube is positioned within the second tube. A one piece collet is positioned within the second tube and encircles the first tube. The collet comprises a locking means for selectively securing the first tube in relation to the second tube, the locking means cooperating with a portion of the second tube upon a rotation of the collet to prevent a telescoping movement of the first tube in relation to the second tube.

Further in accordance with this aspect of the invention, a means is provided for preventing the first tube from rotating in relation to the collet. Preferably, a means is also provided for securing the collet to the second tube. In addition, a means is preferably provided for preventing the collet from sliding completely within the second tube. It is further desirable to provide a means for preventing the first tube from sliding out of the collet. In addition, it is desirable to provide a means for preventing the first tube from sliding completely into the second tube.

In accordance with another aspect of the invention, a telescoping assembly is provided.

More particularly in accordance with this aspect of the invention, the telescoping assembly comprises a first tube having an outer diameter and a second tube having an inner diameter which is larger than the outer diameter of the first tube so that the first tube fits within the second tube in a sliding manner. A collet is positioned within the second tube and encircles the first tube. The collet comprises a locking means for selectively securing the first tube in relation to the second tube to prevent a telescoping movement of the first tube in relation to the second tube. Further provided is a means for securing the collet to the second tube and a means for preventing the first tube from rotating in relation to the collet.

In accordance with a further aspect of the invention, a telescoping wand assembly for a vacuum cleaner is provided.

More particularly in accordance with this aspect of the invention, the telescoping wand assembly comprises a first tube having an outer diameter. A second tube having an inner diameter which is larger than the outer diameter of the first tube is provided so that the first tube fits within the second tube in a sliding manner. The second tube includes an inner periphery on which is defined a shelf. A collet is positioned within the second tube and encircles the first tube. The collet comprises a flexible section which, upon rotation of the collet, will engage the shelf defined on the second tube and the outer periphery of the first tube to selectively secure the first tube in relation to the second tube to prevent a telescoping movement of the first tube in relation to the second tube.

One advantage of the present invention is the provision of a new and improved telescoping assembly.

Another advantage of the present invention is the provision of an infinitely adjustable telescoping assembly which utilizes a minimum of parts.

Still another advantage of the present invention is the provision of a telescoping assembly utilizing a collet which provides a locking means for selectively securing a first tube in relation to a second tube to prevent a telescoping movement of the tubes in relation to each other.

Yet another advantage of the present invention is the provision of a telescoping assembly including first and second tubes and a collet in which a means is provided for preventing the first tube from rotating in relation to the collet.

Still yet another advantage of the present invention is the provision of a telescoping assembly comprising a first tube, a second tube and a collet in which a means is provided for securing the collet to the second tube.

A further advantage of the present invention is the provision of a telescoping assembly comprising first and second tubes and a collet in which a means is provided for preventing the collet from sliding completely within the second tube.

A still further advantage of the present invention is the provision of a telescoping assembly comprising first and second tubes and a collet in which a means is provided for preventing the first tube from sliding out of the collet.

A yet further advantage of the present invention is the provision of a telescoping assembly comprising first and second tubes and a collet in which a means is provided for preventing the first tube from sliding completely into the second tube.

An additional advantage of the present invention is the provision of an infinitely adjustable, simple-to-use telescoping wand assembly for vacuum cleaners which utilizes a minimum of parts.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof and wherein.

DETAILED DESCRIPTION OF THE PREFERRED EMBODIMENT

Figure 2:
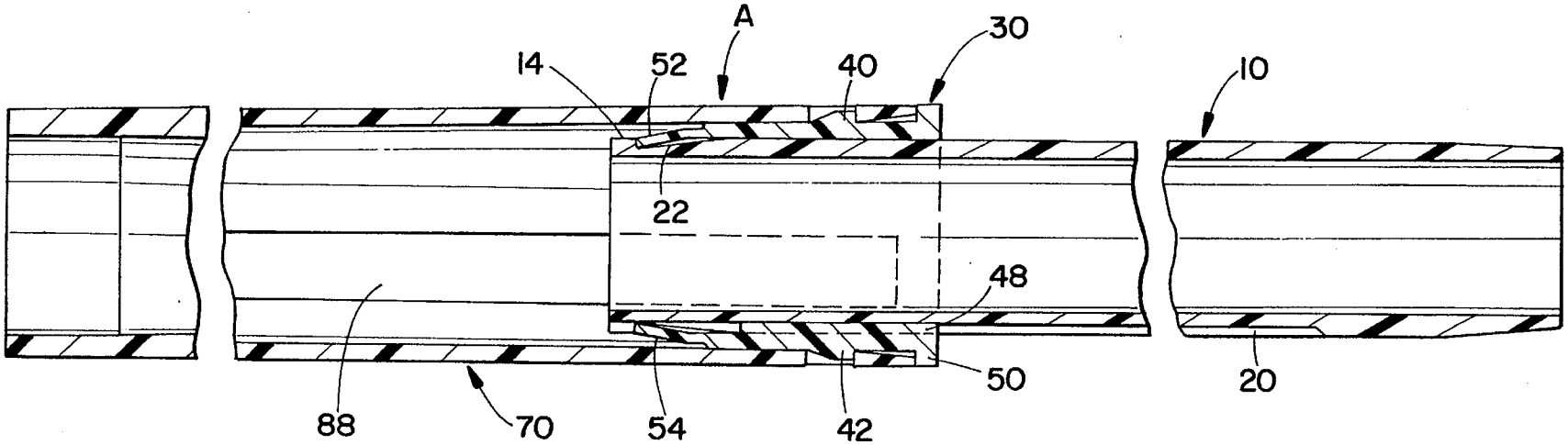
FIG. 2 is an enlarged side elevational view in cross section of the telescoping assembly of FIG. 1 in an assembled condition.

Referring now to the drawings, wherein the showings are for purposes of illustrating a preferred embodiment of the invention only and not for purposes of limiting same, FIG. 2 shows a telescoping assembly A. While the telescoping assembly A is primarily designed for and will hereinafter be described in connection with a telescoping wand for vacuum cleaners, it should be appreciated that the telescoping assembly can also be used in a wide variety of other environments in which an adjustable length tubular member is required such as conduits which can be used in a wide variety of fluid supply or fluid withdrawal environments.

Figure 1:
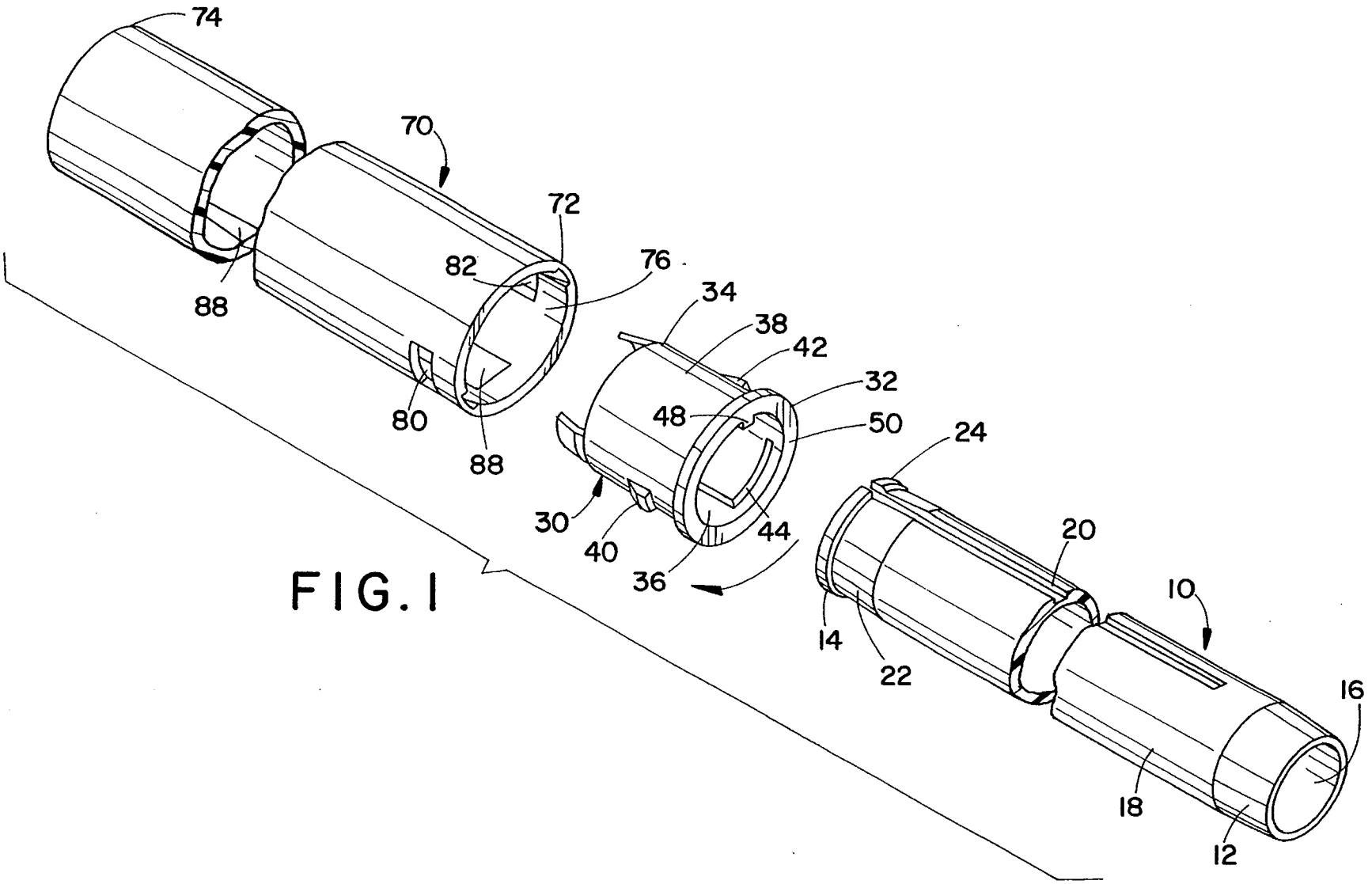
FIG. 1 is an exploded perspective view, partially broken away, of the telescoping assembly according to the preferred embodiment of the present invention.

With reference now to FIG. 1, the wand assembly A comprises a first wand section 10 having a first end 12 and a second end 14. Defined between the two ends is a longitudinally extending bore 16 which forms an inner periphery of the first wand section 10. Also defined on the first wand section is an outer periphery 18. Located in the outer periphery is a longitudinally extending slot 20. Provided along the second end 14 of the wand section 10 is a tapered area 22. The tapered area tapers inwardly from the outer periphery 18 towards the wand's second end 14 and terminates in a collar 24. Preferably, the collar has a diameter which is identical with the diameter of the remainder of the first wand section.

It is evident that the slot 20 does not extend completely through the body of first wand section 10. The slot 20 extends from the second end 14, where it passes completely through the collar 24, to adjacent the first end 12 as can be seen in FIG. 1.

With continuing reference to FIG. 1, a collet 30 cooperates with the first wand section 10. The collet includes a first end 32 and a second end 34. Extending from the first to the second ends is a longitudinal bore 36 which defines an inner periphery of the collet. Also provided for the collet is an outer periphery 38. Located on the outer periphery is a first tooth 40 and a second tooth 42 such that the two teeth are spaced 180 degrees apart.

Figure 3:
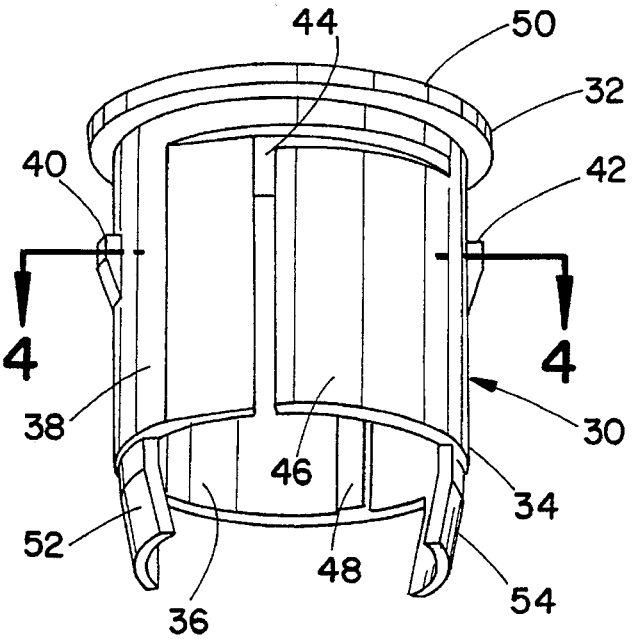
FIG. 3 is an enlarged perspective view of a collet of the telescoping assembly of FIG. 1.
Figure 4:
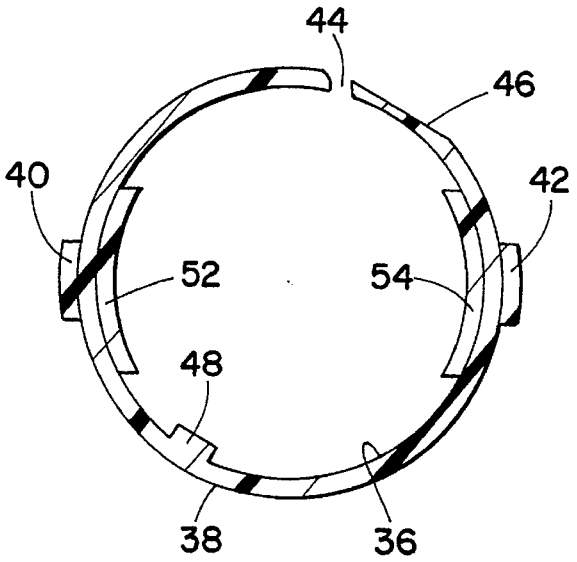
FIG. 4 is a cross-sectional view along lines 4—4 of the collet of FIG. 3.

With reference now also to FIG. 3, it can be seen that the two teeth 40 and 42 are located adjacent the first end 32 of the collet 30. Provided in the collet is an L-shaped slot 44 which defines a flexible section 46 of the collet. As shown in FIG. 4, the flexible section 46 has a lesser thickness than the remainder of the collet so as to enhance its flexibility. Extending within the longitudinal bore 36 and defined on the inner periphery on the collet is a longitudinal rib 48. The rib cooperates with the groove 20 of the first wand section 10 to provide a means for preventing rotation of the first wand section 10 in relation to the collet 30. In other words, when the collet is assembled onto the first wand section 10, as shown in FIG. 2, the collet cannot rotate in relation to the wand section.

The collet is also provided with a collar 50 on its first end 32. Located on the second end 34 of the collet are a pair of fingers 52 and 54. The fingers are spaced from each other by approximately 180 degrees as is evident from FIG. 3.

Figure 6:
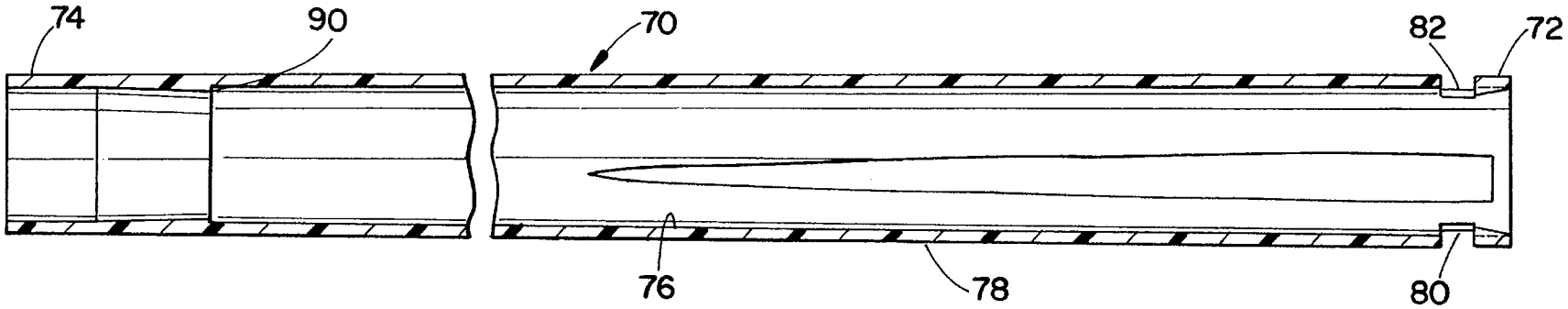
Figure 5:
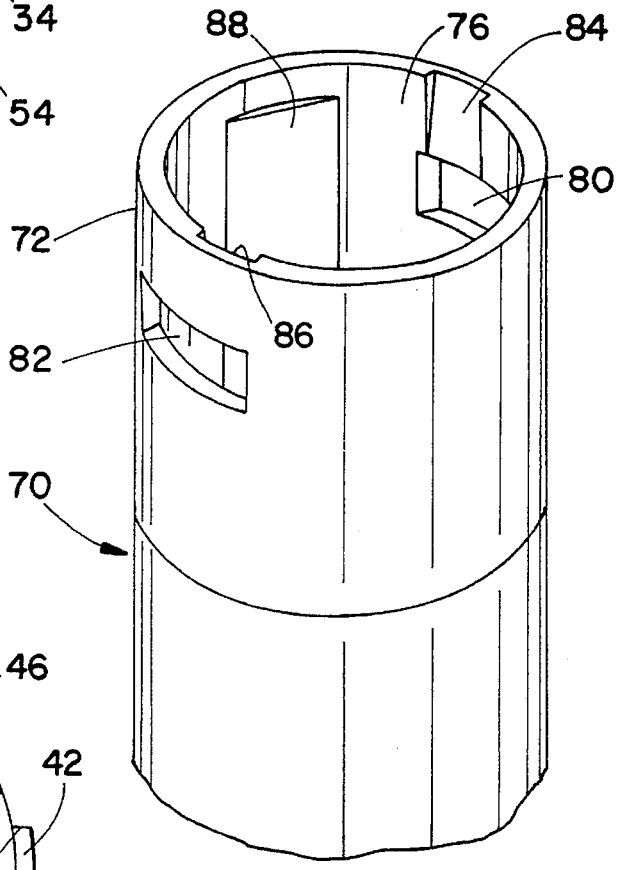
FIG. 5 is an enlarged perspective view of one end of a second tube of the telescoping assembly of FIG. 1; and, FIG. 6 is a reduced side elevational view in cross section of the second tube of FIG. 5.

With reference now to FIG. 6, the wand assembly further comprises a second wand section 70, having a first end 72 and a second end 74. Extending from the first end to the second end of the wand section 70 is a longitudinal bore 76 which defines an inner periphery of the wand section. The second wand section 70 also has an outer periphery 78 in which are defined a first slot 80 and a second slot 82 adjacent the first end 72 thereof. With reference now also to FIG. 5, leading from the first end 72 of the second wand section 70 to the slots 80 and 82 are respective tapering grooves 84 and 86. The grooves 84 and 86 and slots 80 and 82 are designed to accommodate the pair of teeth 40 and 42 of the collet 30 in order to secure the collet in place within the second wand section 70 as can be seen in the assembled view of FIG. 2.

Provided within the longitudinal bore 76 of the second wand section 70 is a shelf 88 which extends longitudinally over a sizable proportion of the length of the second wand as is evident from FIG. 6. The shelf 88 cooperates with the flexible section 46 of the collet. As the first wand section 10 is rotated in relation to the second wand section, the collet 30 is also rotated since these two elements are locked together by the cooperation of the rib 48 with the slot 20 as explained previously. As the collet is rotated along with the first wand section, the flexible section 46 of the collet will come to bear on the shelf 88. This will urge the flexible section 46 of the collet inwardly and against the outer periphery 18 of the first wand section. The flexible section 46 of the collet will therefore provide a friction fit against the outer periphery 18 of the first wand section 10 to prevent the first wand from sliding in relation to the second wand.

Upon a reverse rotation of the first wand section 10 and hence the collet 30, the flexible section 46 will be rotated away from the shelf 88 and will spring outwardly since the collet is made from a suitable resilient material. Therefore, the flexible section 46 will no longer bear on the outer periphery 18 of the first wand section 10 with such force as to prevent the first wand section from being able to slide in relationship to the second wand section 70. Therefore, the first wand section 10 can now be telescoped back and forth in relationship to the second wand section 70. When the new desired length of the wand assembly A is achieved, the first wand section 10 can again be rotated in relation to the second wand section 70 to bring the flexible section 46 of the collet 30 to bear on the outer periphery 18 of the first wand section, as the flexible section 46 is urged inwardly by the shelf 88, and lock the first wand section 10 in place in relation to the second wand section 70.

Serving as a means for preventing the first wand 10 from being slipped out of the collet 30 are the first and second fingers 52 and 54 of the collet 30. As illustrated in FIG. 2, these fingers cooperate with the collar 24 defined on the second end 14 of the first wand 10. As the first wand 10 is pulled out of the second wand 70 and the collet 30, the fingers 52 and 54 will resiliently flex inwardly in the tapered area 22 of the first wand 10, and will come to bear against the collar 24 of the first wand 10. This prevents the first wand 10 from being pulled out of the collet 30 and away from the second wand 70. On the other hand, when the first wand is pushed into the second wand, the first and second fingers 52 and 54 of the collet will resiliently flex outwardly and allow a sliding motion of the first wand 10 in relation to the collet With reference again to FIG. 6, located adjacent the second end 74 of the second wand 70 is a circumferentially extending or annular flange 90. The flanged area provides a reduced diameter section of the longitudinal bore 76. The flange 90 serves as a means for preventing the first wand section 70 from telescoping too far into the second wand section 70 because the second end 14 of the first wand section will abut the annular flange 90 and prevent any further retraction of the first wand section 10 into the second wand section 70.

In a preferred embodiment, the first tubular wand section 10 can be on the order of 16.7 inches (42.4 cm) long. It can have a 0.99 inch (2.5 cm) internal diameter at its second end 14 and a 1.06 inch (2.7 cm) diameter at its first end 12, and a 1.25 inch (3.2 cm) external diameter. Therefore, the first wand section 10 has an internal diameter which tapers somewhat outwardly from its second end 14 to its first end 12. Preferably, the first wand section 10 is made of a suitable thermoplastic such as polystyrene.

The collet 30 can be on the order of 1.8 inches long and have an inner diameter of 1.26 inches (3.2 cm) and an outer diameter of 1.4 inches (3.56 cm), excluding the collar 50. Therefore, the collet can fit around the first wand section 10. The collet 50 can be made from a suitable thermoplastic material such as acetal.

The second wand section 70 can have an inner diameter of 1.41 inches (3.6 cm) at it first end 72 so as to accommodate the collet 50. However, the second wand 70 tapers from its first end 72 to its second end 74 such that the inner diameter of the second end is on the order of 1.26 inches (3.2 cm). The length of the second wand section 70 can be on the order of 17 inches (43.2 cm). Preferably, the second wand section 70 is made of a suitable thermoplastic material such as polystyrene. It should be appreciated that the first and second wand sections and the collet could also be made from other suitable conventional materials as may be desired or required.

The invention has been described with reference to a preferred embodiment. Obviously, modifications and alterations will occur to others upon the reading the understanding of this specification. It is intended to include all such modifications and alterations insofar as they come within the scope of the appended claims or the equivalents thereof.

Having thus described the invention, it is now claimed:

1. A telescoping assembly comprising:

a first tube having an outer diameter;

a second tube having an inner diameter which is larger than said outer diameter of said first tube wherein said first tube is positioned within said second tube;

a one piece collet positioned within said second tube and encircling said first tube, said collet comprising a locking means for selectively securing said first tube in relation to said second tube in a plurality of longitudinal positions, said locking means cooperating with a portion of said second tube upon a rotation of said collet to prevent a telescoping movement of said first tube in relation to said second tube; and a means for preventing said first tube from sliding out of said second tube in any rotational orientation of said first tube.

2. The assembly of claim 1 further comprising a means for preventing said first tube from rotating in relation to said collet.

3. The assembly of claim 2 wherein said means for preventing rotation comprises a rib located on said collet and a longitudinally extending groove located in said first tube, wherein said rib fits into said groove, said rib and groove cooperating to prevent a rotation of said first tube in relation to said collet.

4. The assembly of claim 1 further comprising a means for securing said collet to said second tube.

5. The assembly of claim 4 wherein said means for securing comprises a flange extending radially outwardly from a side wall of said collet and a slot extending through a side wall of said second tube, said flange extending through said slot to secure said collet to said second tube.

6. The assembly of claim 1 further comprising a means for preventing said collet from sliding completely within said second tube.

7. The assembly of claim 6 wherein said means for preventing said collet from sliding completely within said second tube comprises a collar extending circumferentially around one end of said collet said collar cooperating with an end of said second tube to prevent said collet from sliding completely into said second tube.

8. The assembly of claim 1 wherein said collet is secured to said second tube and wherein said means for preventing comprises a flange extending from one end of said collet and a circumferentially extending rib located on one end of said first tube, said flange and rib cooperating to prevent said first tube from sliding out of said second tube.

9. The assembly of claim 1 further comprising a means for preventing said first tube from sliding completely into said second tube.

10. The assembly of claim 9 wherein said means for preventing said first tube from sliding completely into said second tube comprises a reduced diameter section of said second tube, said reduced diameter section being located adjacent one end of said second tube.

11. A telescoping assembly comprising:

a first tube having an outer diameter;

a second tube having an inner diameter which is larger than said outer diameter of said first tube so that said first tube fits within said second tube in a sliding manner;

a collet positioned within said second tube and encircling said first tube, said collet comprising a locking means for selectively securing said first tube in relation to said second tube in a plurality of longitudinal positions, said locking means cooperating with a portion of said second tube upon an associated rotation of said collet and said first tube to prevent a telescoping movement of said first tube in relation to said second tube;

a means for securing said collet to said second tube; and, a means for allowing said first tube to slide axially in relation to said collet when said first tube telescopes into and out of said second tube.

12. The assembly of claim 11 further comprising a means for preventing a rotation of said first tube in relation to said second tube wherein said means for preventing rotation comprises a rib located on said collet and a longitudinally extending groove located in said first tube, wherein said rib fits into said groove, said rib and groove cooperating to prevent a rotation of said first tube in relation to said collet.

13. A telescoping wand assembly for a vacuum cleaner, said assembly comprising:

a first tube having an outer diameter;

a second tube having an inner diameter which is larger than said outer diameter of said first tube so that said first tube fits within said second tube in a sliding manner, said second tube including an inner periphery on which is defined a shelf; and, a collet positioned within said second tube and encircling said first tube, said collet comprising a flexible section which, upon rotation of said collet, will engage said shelf defined on said second tube and said outer periphery of said second first tube to selectively secure said first tube in relation to said second tube to prevent a telescoping movement of said first tube in relation to said second tube at a plurality of relative longitudinal positions between said first and second tubes to which said first tube can be slid within said second tube.

14. The assembly of claim 13 wherein said collet further comprises a collar extending circumferentially around one end thereto, said collar cooperating with an end of said second tube to prevent said collet from sliding completely into said second tube.

15. The assembly of claim 13 wherein said collet further comprises a flange extending from one end thereof, said flange cooperating with a collar located on one end of said first tube, said flange and collar cooperating to prevent said first tube from sliding out of said collet.

16. The assembly of claim 13 wherein said second tube further comprises a reduced diameter section which is located adjacent one end of said second tube, said reduced diameter section of said second tube engaging an end of said first tube for preventing said first tube from sliding completely into said second tube.

17. The assembly of claim 13 wherein said collet further comprises a rib defined on an inner periphery of the collet, said rib cooperating with a groove extending longitudinally along an outer periphery of said first tube to prevent a rotation of said first tube in relation to said collet.

18. A telescoping assembly comprising:

a first tube having an outer diameter, a first end and a second end;

a second tube having an inner diameter, a first end and a second end, wherein said second tube inner diameter is larger than said first tube outer diameter so that said first end of said first tube is slidably positioned within said second end of said second tube;

a collet positioned within said second tube and encircling said first tube, said collet comprising a locking means for selectively securing said first tube in relation to said second tube in a plurality of longitudinally positions, said locking means cooperating with a portion of said second tube upon a rotation of said collet to prevent a telescoping movement of said first tube in relation to said second tube; and, a means for preventing said first tube from sliding out of said second tube in any rotational orientation of said first and second tubes.

19. The assembly of claim 18 further comprising a means for securing said collet to said second tube wherein said means for securing comprises a flange extending radially outwardly from a side wall of said collet and a slot extending through a side wall of said second tube, said flange extending through said slot to secure said collet to said second tube.

20. The assembly of claim 11 further comprising a means for preventing said collet from sliding completely within said second tube, wherein said means for preventing comprises a collar extending circumferentially around one end of said collet said collar cooperating with an end of said second tube to prevent said collet from sliding completely into said second tube.

21. The assembly of claim 11 further comprising a means for preventing said first tube from sliding out of said collet, wherein said means for preventing comprises a flange extending from one end of said collet and a circumferentially extending rib located on one end of said first tube, said flange and rib cooperating to prevent said first tube from sliding out of said collet.

* * * * *